United States Patent [19]

Gernhardt et al.

[11] 4,043,766

[45] Aug. 23, 1977

[54] SLAG BATH GENERATOR

[75] Inventors: Paul Gernhardt, Bochum; Wolfgang Grams, Wanne-Eickel; Wilhelm Danguillier; Siegfried Pohl, both of Bochum, all of Germany

[73] Assignee: Dr. C. Otto & Comp. G.m.b.H., Bochum, Germany

[21] Appl. No.: 735,180

[22] Filed: Oct. 26, 1976

[30] Foreign Application Priority Data

Nov. 20, 1975 Germany ..... 2552077

[51] Int. Cl.[2] ..... C10J 3/30

[52] U.S. Cl. ..... 48/73; 48/92; 48/197 R; 48/202; 48/DIG. 2; 239/433; 239/470; 259/4 R

[58] Field of Search ..... 48/73, 76, 77, 62 R, 48/62, 92, 86 R, 202, 206, 210, 197 R, DIG. 2; 239/8, 9, 268, 310, 399, 433, 463, 468, 470; 259/4 R, 18, 36

[56] References Cited

U.S. PATENT DOCUMENTS

| | | | |
|---|---|---|---|
| 1,098,534 | 6/1914 | Servais | 48/DIG. 2 |
| 2,913,321 | 11/1959 | Rummel | 48/197 R |

*Primary Examiner*—Robert L. Lindsay, Jr.

*Assistant Examiner*—George C. Yeung

*Attorney, Agent, or Firm*—Brown, Murray, Flick & Peckham

[57] ABSTRACT

Nozzles introduce jet streams of fine-grain fuel and a gasification medium downwardly toward the surface of a slag bath at the bottom of a cylindrical reactor shaft within a vessel to impinge upon the surface of liquid slag which is discharged through a centrally-arranged overflow in the bottom of the vessel. The nozzles are arranged at an angle within a range of 35° to 40° with respect to the horizontal and positioned so that the jet streams impinge upon the surface of the slag at points defined by a plurality of concentric circles with respect to the overflow to circulate and produce a resulting movement of the liquid slag toward the overflow while maintaining a high temperature and homogeneous slag bath. The nozzles are further positioned so that an angle of about 10° is defined between each jet stream and a vertical tangential plane to the concentric circle at the point where the jet stream impinges. A pressure of about 25 atmospheres is maintained within the reactor and the exit velocity of the jet stream from the nozzles is between 20 and 50 meters per second, preferably 40 meters per second.

14 Claims, 2 Drawing Figures

SLAG BATH GENERATOR

BACKGROUND OF THE INVENTION

Figure 1:
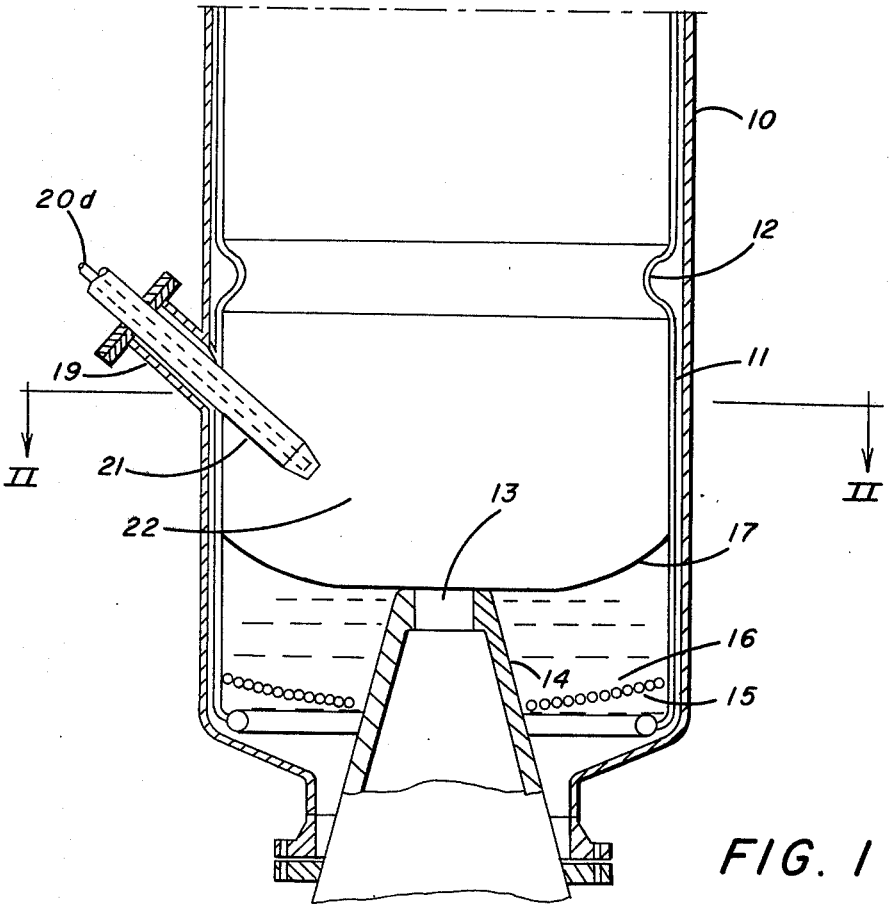

This invention relates to a slag bath generator including a vertical and substantially cylindrical reactor shaft to operate under pressure within a vessel and having a centrally-arranged slag overflow in the base for discharging liquid slag from a slag bath. More particularly, the present invention relates to an improved arrangement of parts including the disposition of nozzles employed for introducing jet streams of fine-grain fuel and a gasification medium in a downward direction toward the surface of the liquid slag of the slag bath.

In a slag bath generator for the gasification of fine-grain fuel and a gasification medium, it is desirable to maintain the liquid slag in the slag bath at a high temperature and with a homogeneous composition. The liquid slag serves as a heat shield for the reactions taking place above the slag bath between the solid fuel and the gasification medium introduced into the reaction vessel. This permits achieving high temperatures and a rapid reaction within the slag bath generator.

The present invention is based on the realization that there must be a sufficiently rapid circular movement of the liquid slag in the bath and the liquid slag undergoing such circular movement must have a component of movement directed toward the centrally-arranged slag bath overflow to maintain a rapid reaction and an adequately rapid overflow of the resulting liquid slag while in its sufficiently-thin (flowable) liquid state.

SUMMARY OF THE INVENTION

It is an object of the present invention to provide an improved arrangement of nozzles for delivering a gasification medium and fine-grain fuel into a slag bath generator to advantageously obtain a circular movement of the slag in the slag bath.

It is still another object of the present invention to provide a particular arrangement of nozzles for delivering a gasification medium and fine-grain fuel into a slag bath generator together with a further relationship of parts thereof to maintain a high temperature and a homogeneous nature to liquid slag while insuring a sufficiently rapid movement of liquid slag toward a centrally-arranged slag overflow within the generator.

According to the present invention, there is provided a slag bath generator including the combination of a vessel defining a vertical and substantially cylindrical reactor shaft within a side wall of a vessel, the vessel including a base for maintaining a liquid slag bath at the bottom of the reactor shaft, a slag bath overflow projecting centrally within the vessel to discharge liquid slag from the vessel, a plurality of nozzles to introduce jet streams of fine-grain fuel and a gasification medium downwardly toward the surface of the slag bath, and supports positioning the nozzles to direct the jet streams of fuel and gasification medium downwardly within the reactor shaft at an angle within the range of 35° to 40° with respect to the horizontal, the supports further positioning the nozzles to direct the jet streams of fine-grain fuel and gasification medium at points of impingement with the surface of the liquid slag defined by a plurality of concentric circles with respect to the overflow to circulate and produce a resulting movement of the liquid slag toward the overflow for maintaining a high temperature and homogeneous slag bath.

The present invention further provides a method for gasifying fine-grain fuel in a slag bath generator having a vertical and substantially cylindrical reactor shaft with a centrally-arranged slag overflow to discharge liquid slag from the bottom of the reactor shaft, the method including the steps of introducing fine-grain fuel and a gasification medium as jet streams through a plurality of nozzles disposed at spaced-apart locations about the reactor shaft, supporting the nozzles by the side wall of a vessel surrounding the reactor shaft to direct each of the jet streams downwardly at an angle of between 35° and 40° to the horizontal, and arranging the nozzles to impinge the jet streams from at least two of the nozzles upon the surface of the liquid slag at points of impingement defined upon different diameters of concentric circles with respect to the overflow to circulate and produce a resulting movement of liquid slag toward the overflow to thereby maintain a high temperature and homogeneous slag bath.

Thus, in the method and apparatus of the present invention, jet streams of fine-grain fuel and a gasification medium are directed by nozzles within the side wall of the vessel forming the reactor shaft at angles of about 35° to 40° with respect to the horizontal. The nozzles are distributed and arranged such that the points of impingement by the jet stream upon the surface of the slag bath are defined by a number of concentric circles extending around the axis of the reactor shaft. When the jet streams are arranged within the aforementioned range of 35° to 40° with respect to the horizontal, the maximum acceleration effect upon the surface of the slag bath is obtained and distributed over the entire surface of the slag bath. Moreover, the nozzles are so disposed that an angle about 10° is formed between a vertical plane containing a jet stream and a vertical tangential plane to the circle containing the point of impingement with the slag bath. The measure of the aforementioned 10° angle is taken at the side of the tangential plane with respect to the point of impingement most remote from the slag outlet. As a result of this construction and arrangement of jet streams, a radial force in the direction toward the centrally-disposed slag overflow is imposed upon the surface of the slag bath.

According to the present invention, it has been found that optimum values to the exit velocity of the fuel in the jet streams of fine-grain fuel and gasification medium are between 20 and 50 meters per second, preferably about 40 meters per second at the discharge end of the nozzles given an operating pressure of 25 atmospheres in the slag bath generator.

The acceleration effect on the fuel discharged by the nozzles naturally decreases with an increase in distance between the nozzles and the surface of the slag bath. On the other hand, it is desirable that the fuel should be gasified to the greatest possible extent before the jet streams impinge upon the surface of the slag bath. In order to obtain an optimum balance between these two considerations, the nozzles are so disposed according to the present invention that the length of the jet stream of fine-grain fuel and gasification medium has a certain value until impingement upon the surface of the slag bath. The magnitude of this length is dependent upon the inside diameter of the substantially cylindrical reactor shaft formed within the side walls of the slag bath generator. Given a diameter of between 1.1 meters and 2.2 meters for the reactor shaft within the reactor vessel, the length of the jet stream of fine-grain fuel and gasification medium before impingement upon the surface of the slag bath is between 400 and 1200 millimeters. In a similar way, given the inside diameter of a reactor vessel of 1.4 meters, the optimum distance of travel by the jet stream has been found to be 600 millimeters. Moreover, given an inside diameter of 2.0 meters to the reactor, the optimum distance of travel by the jet stream is between 900 and 1000 millimeters.

Figure 2:
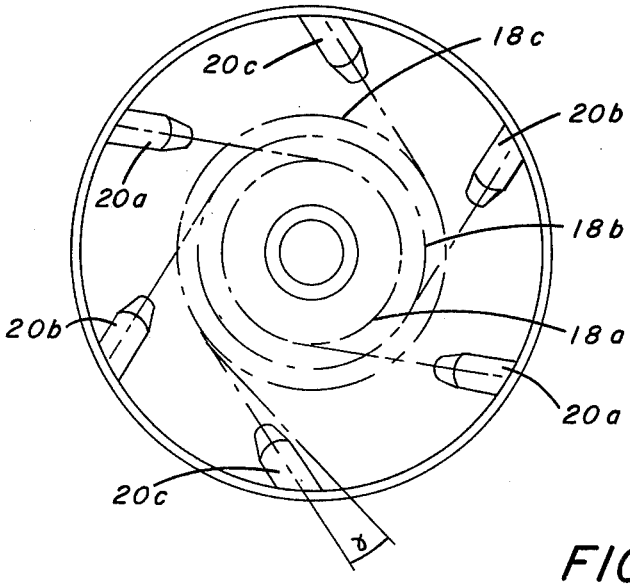

These features and advantages of the present invention as well as others will be more fully understood when the following description is read in light of the accompanying drawings, in which:

FIG. 1 is an elevational view, in section, illustrating the lower portion of a slag bath generator according to the method and apparatus of the present invention; and FIG. 2 is a sectional view taken along line II—II of FIG. 1.

In FIGS. 1 and 2, there is illustrated a slag bath generator which includes a reactor vessel having a side wall 10 which is lined with cooling tubes 11 extending vertically around the inside of the reactor vessel. A generator reaction chamber 22 is bounded at the top by a constriction 12 formed by inwardly-bent portions of the cooling tubes 11. A central aperture 13 in a conical insert 14 defines an overflow for liquid slag from a slag bath 16 collected above the base 15 of the slag bath generator. A water tank, not shown, is disposed below the insert 14 for collecting the liquid slag passed through the aperture 13 from the slag bath. The liquid slag solidifies in the water tank.

As described hereinbefore, the object of the present invention is to maintain the liquid slag bath 16 in a sufficiently-thin, liquid state and the surface 17 of the slag is to undergo circular movement as shown by the dot-dash line circles 18A, 18B and 18C in FIG. 2. The special arrangement of nozzles according to the present invention is carried by means of supports 19 which are arranged to carry the nozzles in the manner described hereinafter more fully. Fine-grain fuel, e.g., coal, and a gasification medium, e.g., steam and/or oxygen, are fed through nozzles 20A, 20B and 20C located within tubes 21 carried by the supports 19. The fine-grain fuel is delivered by conveying gas, which is the gasification medium, through the nozzles 20A, 20B and 20C at an exit velocity of between 20 and 50 meters per second, preferably at 40 meters per second. Namely, when the inside diameter of the wall 10 is between 1.4 meters and 2.2 meters, the length of the jet stream from the nozzles until impingement upon the surface of the slag bath is between 400 and 1200 millimeters. More specifically, when the diameter of the reactor shaft within wall 10 is 1.4 meters, the optimum length of a jet stream is 600 millimeters; while given a diameter of a reactor shaft 2 meters, the optimum length of a jet stream is between 900 and 1000 millimeters.

As described hereinbefore, the reactor shaft extends vertically and thereby defines a central axis which is aligned and extends through the central aperture 13 in the insert 14. The position of the individual nozzles with respect to the axis of the generator shaft is varied according to the present invention such that the jet streams of fine-grain fuel and gasification medium supplied by the nozzles 20A, 20B and 20C impinge upon the surface of the slag bath at points contained on the circles 18A, 18B and 18C. This arrangement of nozzles is further defined in other respects such that an angle of 10° is formed between a vertical plane containing the jet stream and a tangential vertical plane at the point of impingement by the jet stream upon the surface of the liquid slag at the relevant circle. The measure of this 10° angle is defined between the jet stream plane and the tangential vertical plane at the side of the point of impingement most remote from the slag outlet, i.e., aperture 13.

FIG. 2 illustrates the tangential vertical plane with respect to a jet stream plane emerging from the lowermost nozzle 20C. The angle $\alpha$ shown in FIG. 2 corresponds to the 10° angle. The movement of the liquid slag is in the direction of the aperture 13 and promoted in the top layers of the slag bath by the nozzle arrangement of the present invention.

As described above, given a diameter of 1.4 meters to the reactor shaft, the distance between the end of nozzles 20A, 20B and 20C and the point of impingement by the jet stream upon the surface 17 of the slag bath is about 600 millimeters.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A slag bath generator including the combination of:

a vessel defining a vertical and substantially cylindrical reactor shaft within a side wall of the vessel, said vessel including a base for maintaining a liquid slag bath at the bottom of the reactor shaft, a slag bath overflow projecting centrally within said vessel to discharge liquid slag of the slag bath from the vessel, a plurality of nozzles to introduce jet streams of fine-grain fuel and a gasification medium downwardly toward the surface of said slag bath, and supports positioning said nozzles to direct said jet streams downwardly within the reactor shaft at an angle within the range of 35° to 40° with respect to the horizontal, the supports further positioning said nozzles to direct said jet streams of fine-grain fuel and gasification medium at points of impingement with the surface of the liquid slag bath defined on a plurality of concentric circles with respect to said overflow to circulate and produce a resulting movement of the liquid slag toward the overflow for maintaining a high temperature and homogeneous slag bath.

2. The slag bath generator according to claim 1 wherein said nozzles are positioned by said supports to define an angle of about 10° between a vertical plane containing each jet stream and a vertical tangential plane to the concentric circle at the point where the jet stream impinges with the circle upon the surface of the slag bath.

3. The slag bath generator according to claim 1 wherein said vessel is further defined to provide a reaction pressure of about 25 atmospheres, and wherein said nozzles deliver said fine-grain fuel in said gasification medium at an exit velocity of between 20 and 50 meters per second at the nozzles.

4. The slag bath generator according to claim 3 wherein said nozzles have means for delivering said fine-grain fuel in said gasification medium at an exit velocity of 40 meters per second at the nozzles.

5. The slag bath generator according to claim 3 wherein the side wall of said vessel defines a reactor shaft having a diameter within the range of 1.4 and 2.2 meters, and wherein the distance between each of said nozzles and the point of impingement of the jet stream therefrom upon the surface of the liquid slag lies between 400 and 1200 millimeters.

6. The slag bath generator according to claim 5 wherein the distance between each of said nozzles and the point of impingement of the jet stream therefrom upon the surface of the liquid slag is 600 millimeters in said vessel having a diameter of 1.4 meters.

7. The slag bath generator according to claim 5 wherein the distance between each of said nozzles and the point of impingement of the jet stream therefrom upon the surface of the liquid slag is between 900 and 1000 millimeters in said vessel having a diameter of 2.0 meters.

8. A method for gasifying fine-grain fuel in a slag bath generator having a vertical and substantially cylindrical reactor shaft with a centrally-arranged slag overflow to discharge liquid slag from the bottom of the reactor shaft, said method including the steps of:

introducing fine-grain fuel and a gasification medium as jet streams through a plurality of nozzles disposed at spaced-apart locations about said reactor shaft, supporting said nozzles by the vessel to direct each of said jet streams downwardly at an angle of between 35° and 40° to the horizontal, and arranging said nozzles to impinge the jet streams from at least two of the nozzles upon the surface of the liquid slag bath at points of impingement defined upon different diameters of concentric circles with respect to said overflow to circulate and produce a resulting movement of the liquid slag toward the overflow for maintaining a high temperature and homogeneous slag bath.

9. The method according to claim 8 wherein the arrangement of said nozzles is further defined to include disposing said nozzles to form an angle of 10° defined between the jet stream from each nozzle and a tangential vertical plane to a circle containing the point of impingement by that nozzle.

10. The method according to claim 8 including the further steps of delivering the fine-grain fuel in said jet streams at an exit velocity from said nozzles of between 20 and 50 meters per second, and maintaining a pressure of about 25 atmospheres within said slag bath generator.

11. The method according to claim 10 wherein said exit velocity of the fine-grain fuel in the jet streams is further defined as 40 meters per second.

12. The method according to claim 10 wherein said nozzles are further defined by arranging the nozzles to define a jet stream having a length of 400 to 1200 millimeters before impingement upon the surface of the slag bath within a reaction chamber having an inside diameter lying between 1.4 and 2.2 meters.

13. The method according to claim 12 wherein the length of the jet stream is further defined as 600 millimeters for impingement upon the surface of the slag bath within a reaction chamber having a diameter of 1.4 meters.

14. The method according to claim 13 wherein the length of the jet stream is further defined to lie between 900 and 1000 millimeters for impinging fine-grain fuel and a gasification medium upon the surface of a slag bath in a reaction chamber having a diameter of 2.0 meters.

* * * * *